United States Patent [19]

Yoshida et al.

[11] Patent Number: 4,813,867

[45] Date of Patent: Mar. 21, 1989

[54] RADIANT TUBE BURNER

[75] Inventors: Yasushi Yoshida, Niiza; Nobuyoshi Oomori, Ichikawa; Kaneaki Hyodo, Hiroshima; Kenji Atarashiya, Hiroshima; Norihisa Shiraishi, Kurashiki; Toshiyuki Hashime, Kurashiki, all of Japan

[73] Assignees: Nihon Nensho System Kabushiki Kaisha; Mitsubishi Jukogyo Kabushiki Kaisha, both of Tokyo; Kawasaki Seitetsu Kabushiki Kaisha, Hyogo, all of Japan

[21] Appl. No.: 60,395

[22] PCT Filed: Oct. 30, 1986

[86] PCT No.: PCT/JP86/00550

§ 371 Date: May 25, 1987

§ 102(e) Date: May 25, 1987

[87] PCT Pub. No.: WO87/02756

PCT Pub. Date: May 7, 1987

[30] Foreign Application Priority Data

| | | | |
|---|---|---|---|
| Oct. 31, 1985 | [JP] | Japan | 60-242930 |
| Nov. 29, 1985 | [JP] | Japan | 60-267348 |
| Oct. 7, 1986 | [JP] | Japan | 61-237016 |
| Oct. 7, 1986 | [JP] | Japan | 61-237017 |

[51] Int. Cl.[4] ..... F23D 15/02

[52] U.S. Cl. ..... 431/353; 431/186; 126/91 A

[58] Field of Search ..... 431/353, 202, 186; 126/91 A

[56] References Cited

U.S. PATENT DOCUMENTS

| | | | |
|---|---|---|---|
| 1,870,013 | 8/1932 | Keenan, Jr. | 431/186 |
| 3,154,134 | 10/1964 | Bloom | 431/186 |
| 3,236,460 | 2/1966 | Wood et al. | 431/186 |
| 3,256,842 | 6/1966 | Vigneron et al. | 431/186 |
| 4,062,343 | 12/1977 | Spidman | 431/353 |
| 4,157,241 | 6/1979 | Samuelson | 431/353 |
| 4,334,854 | 6/1982 | Graaf et al. | 431/186 |
| 4,451,230 | 5/1984 | Bocci et al. | 431/186 |
| 4,502,217 | 3/1985 | Winclet et al. | 431/186 |
| 4,602,571 | 7/1986 | Chadsbay | 431/186 |
| 4,673,350 | 6/1987 | Collier | 431/353 |

FOREIGN PATENT DOCUMENTS

| | | | |
|---|---|---|---|
| 0023617 | 3/1981 | Japan | 126/91 A |

*Primary Examiner*—Margaret A. Focarino

*Attorney, Agent, or Firm*—Toren, McGeady & Associates

[57] ABSTRACT

A radiant tube burner is presented comprising a gas burner having a divergent flame type nozzle at its end and designed to be movable in the axial direction while placed coaxially in a combustion tube, primary air swirling vanes located at the end of the burner for forming a swirled flame and an air damper fitted on a primary air supply tube connected to the combustion tube for adjusting the primary and the second air ratio, whereby soft two-stage combustion takes place in the radiant tube. Generation of NOx is greatly reduced with the newly invented burner.

3 Claims, 9 Drawing Sheets

RADIANT TUBE BURNER

BACKGROUND OF THE INVENTION

1. Field of the Invention

This invention relates to a radiant tube burner in which a nozzle of a gas burner is coaxially placed in a combustion tube located in a radiant tube so that the burner can be moved in the axial direction, fuel gas issuing from the gas burner undergoes primary combustion by primary air supplied through the annular space between the gas burner and the combustion tube and further undergoes secondary combustion by secondary air supplied through the annular space between the combustion tube and the radiant tube and, more particularly to a radiant tube burner used for heat treatment furnaces or the like. The newly invented burner is capable of reducing the amount of NOx contained in the exhaust gas discharged from the radiant tube.

2. Description of the Prior Art

There has been a proposal in the design of radiant tube burners in which a damper is provided at the inlet of the primary air admitted into the combustion tube, for example, to restrain the generation of NOx, thereby making it possible to change the primary and the secondary air ratio. (See Japanese Utility Model Laid-open No. Sho 52-21036)

However, it has been found out that the amount of generated Nox cannot be sufficiently reduced only by adjusting the primary and the secondary air ratio.

Further, there has been known another proposal in which a steam tube is provided in the fuel gas nozzle to eject steam into the flame formed by burner combustion, to make it possible to reduce the flame temperature to restrain the generation of NOx (See Japanese Patent Laid-open No. Sho 52-29007).

When comparing the case of ejecting steam with that of atomizing water, the latter is more effective in reducing the flame temperature, thus leading to higher reduction of Nox. However, an adverse effect on the radiant tube and instability of the flame may be expected due to the relatively large particle size of atomized water so that the practical use has been considered to be impossible.

SUMMARY OF THE INVENTION

It is an object of the present invention to provide a radiant tube burner in which high heat load primary combustion is caused to happen in satisfactory and stable way by swirling the primary air and soft secondary combustion takes place in a radiant tube, thereby making it possible to obtain low NOx.

In order to attain the first object, according to the present invention, a divergent flame type nozzle is installed movably in the axial direction, while swirling vanes are provided on the outer periphery thereof and air dampers for adjusting the primary and the secondary air ratio are provided on the outside of a primary air supply tube.

Another object of the present invention is to provide a radiant tube burner in which the flame temperature is reduced by means of adding atomized water into the combustion flame, thereby making it possible to obtain low NOx, while high heat load combustion is going on in satisfactory and stable way owing to the two-stage combustion described above.

In order to attain the second object, a water spray nozzle is placed at the center of the divergent flame type nozzle, said nozzle being connected to an atomized water generator capable of supplying pressurized gas and additive water through an additive water transfer tube installed in the gas burner.

Further, as a different advantageous means according to the present invention, the atomized water generator is composed of a cylinder having a conical hole to be connected to the additive water transfer tube, a recessed disk having grooves for injecting pressurized gas and additive water thereinto and fitted to said cylinder and a housing for accommodating said cylinder and said disk.

It is also another object of the present invention to provide a radiant tube burner in which, in addition to the aforementioned features, the exhaust gas is used as atomizing medium, thereby accomplishing enhanced reduction of NOx while high heat load and low NOx combustion occurs due to the swirling of the primary air and addition of atomized water into the combustion flame.

In order to attain the third object, the atomized water generator is connected to the exhaust gas pipe, while other parts remain the same as described in the second object.

Further, as another advantageous means to materialize the object of the invention, low pressure fuel gas can be used as atomizing medium. In this case, the water atomizer is connected to the fuel gas while other parts remain the same as described in the second object.

In addition, as another advantageous means, an exhaust gas introducing tube and a water out-flow nozzle are placed at the central portion of the divergent flame tube nozzle to utilize the velocity energy of low pressure exhaust gas to atomize the water supplied from the additive water transfer tube.

The above-mentioned objects and features of this invention will be evident from the following description presented in reference to the drawings which indicate embodiment of the invention.

DESCRIPTION OF THE PREFERRED EMBODIMENTS

Figure 1:
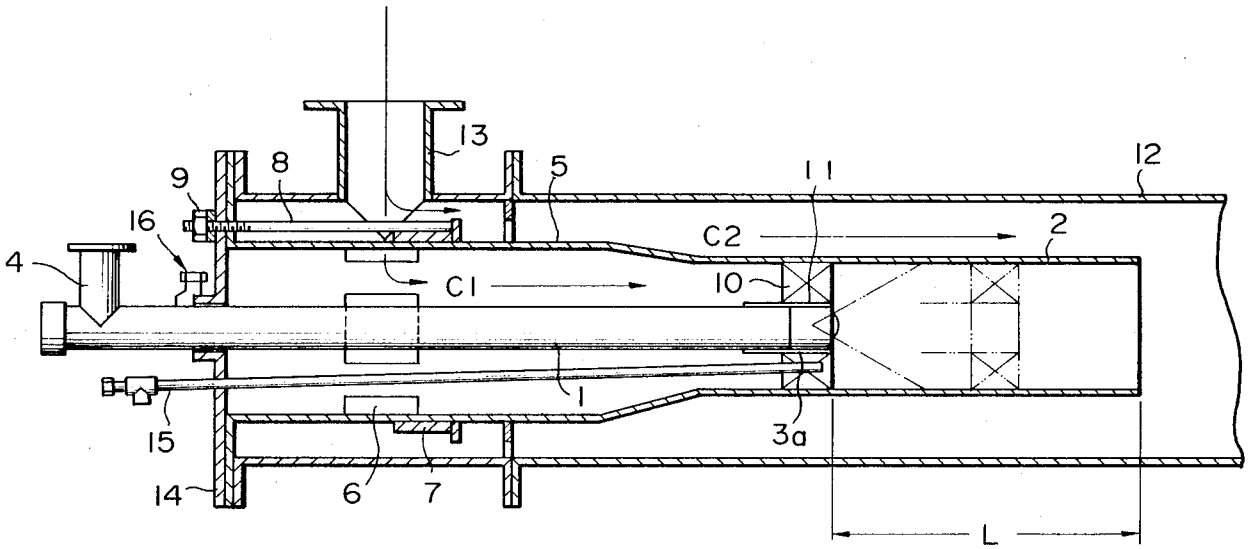
FIG. 1 is a longitudinal sectional view showing an embodiment of the radiant tube burner according to the present invention.
Figure 2:
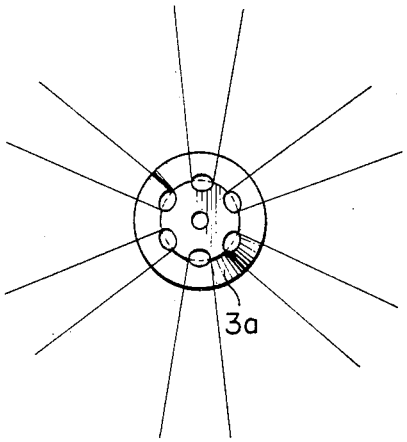
FIGS. 2 and 3 are a front view and a sectional view showing the divergent flame type nozzle in the burner of the present invention.
Figure 3:
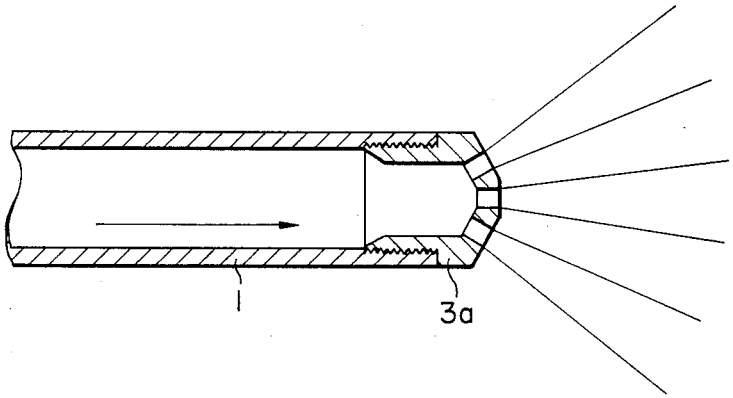
Figure 4:
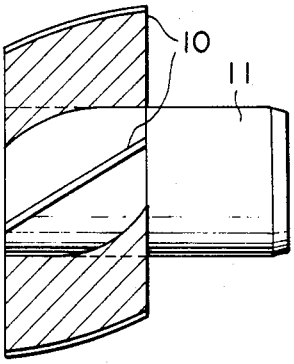
FIGS. 4 and 5 are a longitudinal sectional view and a front view showing primary air swirling vanes in the burner of the present invention.
Figure 5:
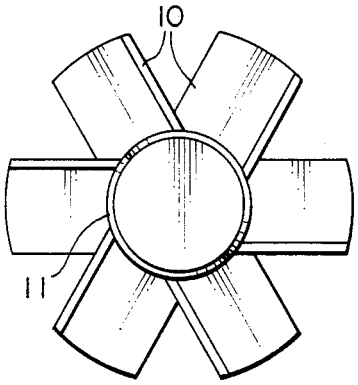

Referring to FIG. 1 showing the first embodiment, a gas burner 1 is coaxially placed with a combustion tube 2. A divergent flame type nozzle 3*a* (see FIGS. 2 and 3) is mounted at the end of the burner 1. At the rear end of the burner 1, there is a fuel gas connection 4. A primary air supply tube 5 joins the rear end of the combustion tube 2 to form an integral piece extending coaxially with the burner 1. The primary air supply tube 5 has four rectangular ports 6 evenly spaced over the entire periphery thereof. The area of the inlet 6 can be changed by moving, with an operating rod 8 and a nut 9, a cylindrical air damper 7, into which the air supply tube 5 is loosely fitted. Primary air swirling vanes 10 having an angle within the range from 15° to 60° are secured on a retaining tube 11 at the front end of said burner 1, as shown in FIGS. 4 and 5. The combustion tube 2 and the primary air supply tube 5 are coaxially housed in a radiant tube 12. An air supply connection 13 is provided at the rear section of the radiant tube 12 in which the inlet ports 6 are located. An end cover 14 closes rear ends of the primary air supply tube 5 and radiant tube 12. The gas burner 1 is installed across said end cover 14 to extend rearward. Reference numeral 15 designates a pilot burner. The gas burner 1 extends movably through the end cover 14 in the axial direction within the range of the combustion tube 2 together with the pilot burner 15. Accordingly, the divergent flame type nozzle 3*a* is supported in the combustion tube 2 through the swirling vanes 10 so that the nozzle position is changeable.

The set position L of the divergent flame type nozzle 3*a* is changeable within the range from 100 to 500 mm. As shown in FIG. 1, the position L is relative to the outer end of the combustion tube 2. The burner 1 is fixed by a bolt 16 attached on the end cover 14.

Next, the operating mechanism of the radiant tube burner according to the first embodiment of the present invention will be described in the following. Referring to FIG. 1, the gas supplied to the gas burner 1 through the connection 4 is ejected from the divergent flame type nozzle 3*a* into the combustion tube 2 at the maximum ejection angle of 60° and at the speed ranging from 10 to 100 m/sec. The jetted fuel gas mixes with primary air $C_1$ which flows through the inlet 6 and is swirled by the swirling vanes 10 before being burnt in reduced primary combustion at the high heat load within the range from $500\times10^4$ kal/m$^3$−h 1,000$\times10^4$ kcal/m$^3$−h. The primary combustion gas issues from the combustion tube 2 in the axial direction into the radiant tube 12 at the speed within the range from 10 to 30 m/sec. Secondary air $C_2$ (90 to 50%) throttled by the air damper 7 to be at a required ratio with respect to the primary air $C_1$ (10 to 50%) is fed through the annular passage between the combustion tube 2 and the radiant tube 12 while cooling said combustion tube 2 at a speed slower than that of the primary combustion gas. The secondary air $C_2$ flows along the inside of the radiant tube 12 due to the kinetic energy differential between the secondary air $C_2$ and the primary combustion gas, while making the secondary combustion occur in less concentrated way to prevent localized heating at the boundary against the primary combustion gas, thereby controlling the generation of NOx.

Test result with a 7 inch (17.5 cm) radiant tube burner according to the first embodiment of the present invention are as follows. The heat rate was as much as 145,000 kcal/h while generally accepted limit had been 110,000 kcal/h with prior art. NOx may be reduced to 80 through 150 ppm by changing the position of the nozzle 3*a* and the primary and the secondary air ratio. Furthermore, there was little soot and carbon monoxide even under the stringent condition where the residual $O_2$ in the exhaust gas was less than one percent. It is also possible to obtain turn-down ratio less than 10% down to which stable combustion can be performed without blowout even when combustion air flow capacity is held at 100% and fuel gas is throttled down to 10%.

Regarding the tube temperature, which is an important factor in the operation of radiant tube burners, it is possible to obtain uniform tube temperature due to the rotation of the flame, with the temperature change in the circumferential direction within 10° C. Further, the temperature difference in the axial direction between the maximum and the minimum in the furnace is made within 150° C. so that extended tube life can be expected.

Figure 6:
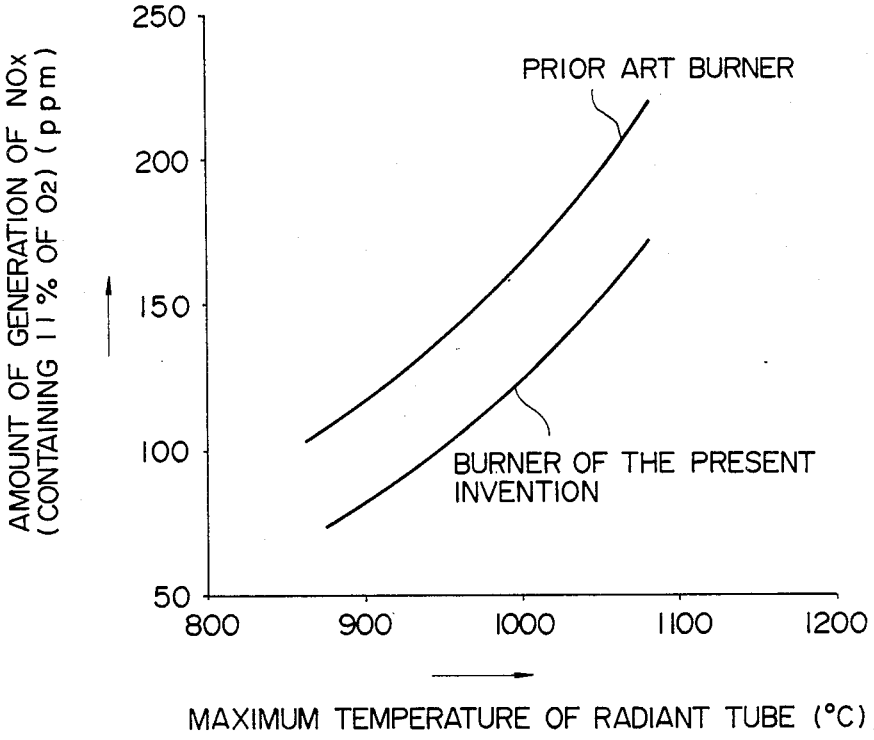
FIG. 6 shows the amount of generated NOx versus the maximum temperature of the radiant tube for explaining the effect of NOx reduction in the radiant tube burner according to the present invention.

FIG. 6 shows the maximum temperature of the radiant tube versus the amount of generation of NOx to explain the effect of NOx reduction according to the present invention. It is obvious that NOx can be reduced by approximately 30% compared with a prior art radiant tube burner.

Next, the second embodiment according to the present invention is described in the following with reference to FIG. 7. The numbers in FIG. 7 refer to the corresponding parts which are the same as illustrated in FIG. 1.

Figure 7:
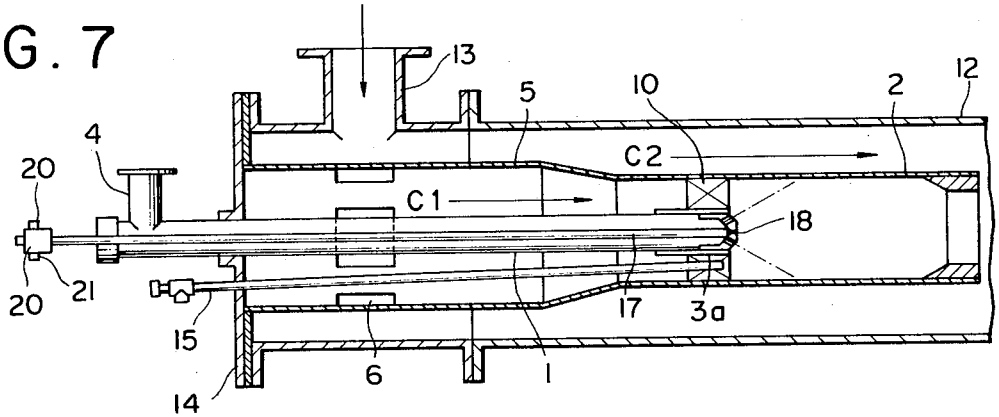
FIG. 7 is a longitudinal sectional view showing a second embodiment of the radiant tube burner according to the present invention.
Figure 8:
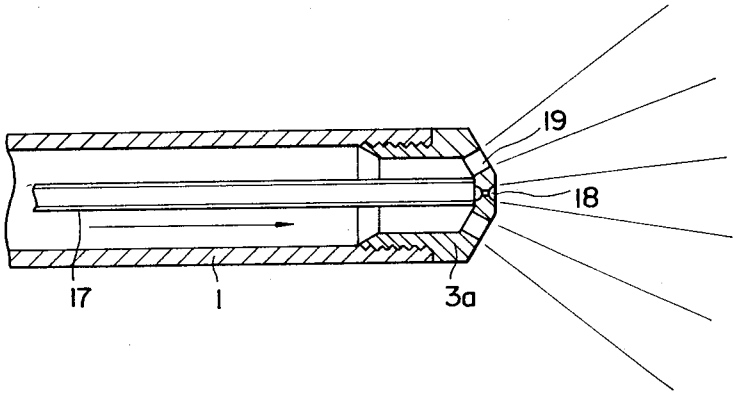
FIG. 8 is a longitudinal sectional view showing the divergent flame type nozzle used in the burner of the present invention.

Referring to FIGS. 7 and 8, the gas burner 1 is placed coaxially with the combustion tube 2. The divergent flame type nozzle 3*a* is mounted at the end of the burner 1. At the rear end of the burner 1, there is the fuel gas connection 4. The primary air supply tube 5 joins the rear end of the combustion tube 2 to form an integral piece extending coaxially with the burner 1. The primary air supply tube 5 has four rectangular ports 6 evenly spaced over the entire periphery thereof. The primary air swirling vanes 10 having an angle within the range from 15 to 60° are secured on a retaining tube (not shown) at the end of said burner 1. The combustion tube 2 and the primary air supply tube 5 are coaxially housed in the radiant tube 12. The primary air supply tube and the radiant tube are closed by the end cover through flanges respectively. Further, the gas burner 1 is installed across the end cover to extend rearward.

A water spray nozzle 18 communicating to an additive water transfer tube 17 placed in said gas burner 1 is provided at the center of the divergent flame type nozzle 3*a* and a multiple number of gas injection ports 19 communicating to the gas connection 4 are provided around said nozzle 18 as shown in FIG. 8. Further, an air supply connection 13 is connected to the rear section of the radiant tube 12. An atomized water generator 22 connected to the pressurized gas tube 20 and the additive water transfer tube 21 is at its rear end.

Figure 9:
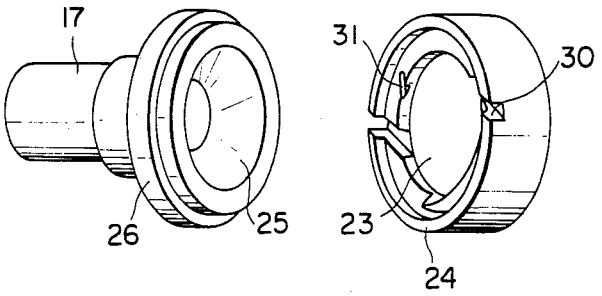
FIGS. 9 and 10 are a fragmentary exploded perspective view and an assembled sectional view showing the atomized water generator in the burner of the present invention.
Figure 10:
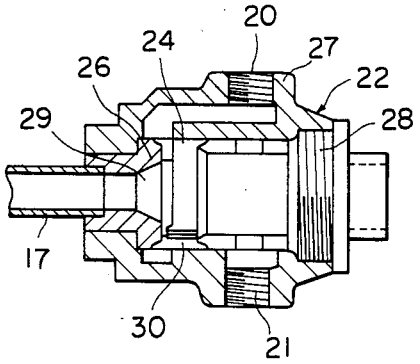

Referring to FIGS. 9 and 10, the atomized water generator 22 consists of a disk 24 having a circular recess 23 and a conical hole 25 with its diameter gradually decreasing from that corresponding to said recess. Further, a cylinder 26 having the same diameter as that of said disk 24 is coaxially fitted to said disk to form integrally with each other and then built in a housing 27. The disk 24 is surely pressed by a plug 28 and the cylinder 26 is connected to the additive water transfer tube 17. When the disk is fitted to the cylinder, an atomized water generating chamber 29 is formed. Grooves 30 and 31 for introducing the pressurized gas and the additive water and communicating to said recess 23 in the tangential direction thereof are provided on one plane perpendicular to the center axis at the end face of the disk 24 near the cylinder 26. These grooves are connected to the pressurized gas supply tube 20 and the additive water supply tube 21 respectively.

The second embodiment of the present invention is a combination of the first embodiment and atomized water injection. For ease of understanding the explanation on the air and the gas flow will be repeated. Referring to FIG. 7, the fuel gas supplied to the gas burner 1 through the connection 4 is ejected from the divergent flame type nozzle 3*a* into the combustion tube 2. The jetted fuel gas mixes with the primary air $C_1$ which flows through the inlet 6 and is swirled by the primary air swirling vanes 10 before being burnt in reduced primary combustion at the high heat load. Then, the primary combustion gas issues from the combustion tube 2 similarly to the first embodiment noted above.

Figure 11:
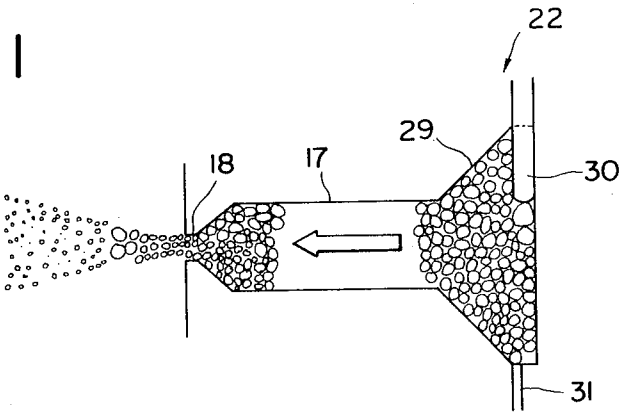
FIG. 11 explains the mechanism of atomized water generation.

On the other hand, the secondary air $C_2$ throttled by the air damper 7 as shown in FIG. 1 to be at a required ratio with respect to the primary air $C_1$ is fed through the annular passage between the combustion tube 2 and the radiant tube 12 while cooling said combustion tube 2 and then flows along the inside of the radiant tube. Thus, the secondary combustion successively occurs to prevent localized heating at the boundary against the primary combustion gas. The atomized water is obtained by the atomized water generator 18 as shown in FIGS. 10 and 11, being injected from the water spray nozzle 18 located at the center of the divergent flame type nozzle 3*a*, thereby reducing the flame temperature to restrain the generation of NOx. In this case, bubbles of the atomized water are sharply expanded to blow up through injection due to the differential pressure across the bubbles and the combustion tube. Since the thickness of the bubble is very thin, i.e., 0.1 $\mu$ m or above, the pieces of the blown-up bubbles are very fine. Therefore, the fine water particles will quickly absorb the latent heat from the flame, thereby greatly reducing the generation of NOx due to the lowered flame temperature.

Figure 12:
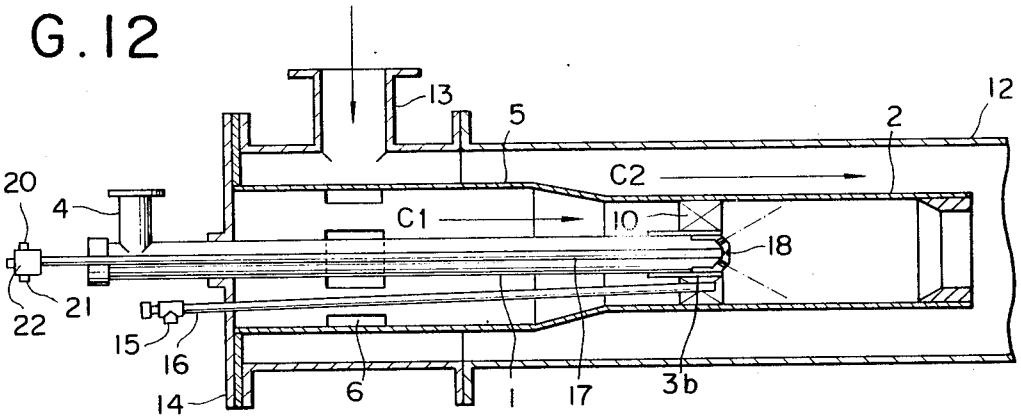
FIG. 12 is a longitudinal sectional view showing a third embodiment of the radiant tube burner according to the present invention.
Figure 13:
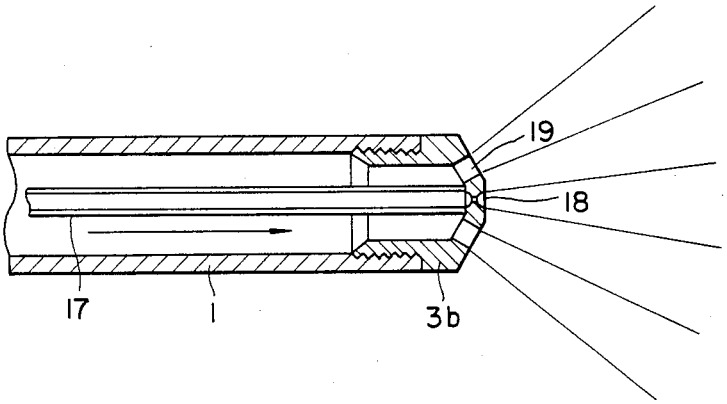
FIG. 13 is a longitudinal sectional view showing the divergent flame type nozzle in the burner of the present invention.

Next, the third embodiment of the radiant tube burner according to the present invention will be described with reference to FIGS. 12 and 13. The numbers in FIGS. 12 and 13 refer to the corresponding parts which are the same as illustrated in FIGS. 7 and 8. However, it differs from the second embodiment in such a point that the exhaust gas is ejected into the center of the fuel gas as atomizing medium while in the second embodiment water is used as atomizing medium.

Since the mechanism of the radiant tube burner in the third embodiment of the present invention is similar to that of the second embodiment with only such difference that the nozzle is constituted as a divergent flame type nozzle 3*b*, the description thereof will be omitted.

Figure 14:
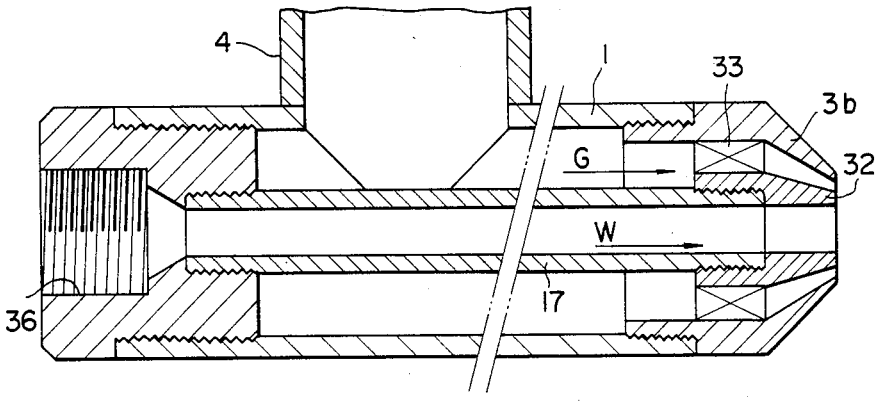
FIG. 14 is a view, partially cross-section, showing a major portion of a fourth embodiment of the radiant tube burner according to the present invention using the water atomizing system with low pressure fuel gas.

Next, FIG. 14 shows a modification of the third embodiment of the present invention which is related to the atomizing system due to low pressure fuel gas. As shown the gas burner 1 is placed coaxially with the combustion tube 2. The divergent flame type nozzle 3*b* is provided at the front end of the burner 1. A water outflow nozzle 32 is provided at the center of the nozzle 3*b*. In the annular space defined by the water outflow nozzle and the exhaust gas nozzle are installed gas swirling vanes 33 having an angle within the range from 15° to 40° .

Next, the operating mechanism of the radiant tube burner of the modification of the third embodiment employing the atomizing system with low pressure fuel gas will be described in the following. As shown in FIG. 14, the gas G introduced into the gas burner 1 from the gas connection 4 is fed in the direction shown by the arrow to be swirled at high speed by the gas swirling vanes 33, while the water W introduced into the additive water transfer tube 17 (See FIGS. 12 and 13) connected to an additive water connection port 36 is fed in the direction shown by an arrow to issue from the water outflow nozzle 32. In this case, the water discharged from the water outflow nozzle is atomized by the velocity energy of the fuel gas.

Thus, since the water is atomized by the velocity energy of the fuel gas, the atomized water and fuel gas are sufficiently mixed with each other and the effect of water addition is greatly enhanced.

Figure 15:
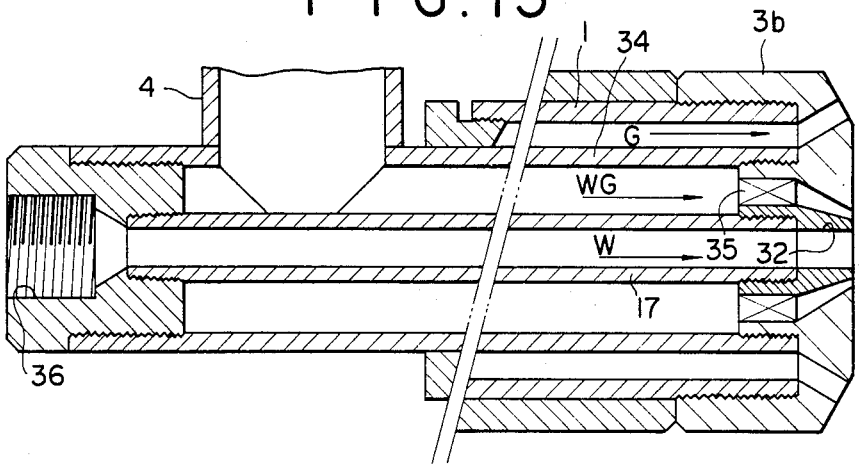
FIG. 15 is a view, partially cross-section, showing a major portion of a fifth embodiment of the radiant tube burner according to the present invention adopting the atomized water system by low pressure exhaust gas.

FIGS. 14 and 15 show a modification of the third embodiment of the present invention which is related to the atomizing system with low pressure exhaust gas. As shown in the figures, an exhaust gas introducing tube 34 for atomizing the water supplied from the water outflow nozzle 32 is placed at the center of the divergent flame type nozzle 3*b*. The additive water transfer tube 17 is placed at the center of the introducing tube 34. In the annular space defined by the water outflow nozzle and the exhaust gas nozzle are provided exhaust gas swirling vanes 35 having an angle within the range from 15° to 40° .

The mechanism of the radiant tube burner of the modification of the third embodiment employing the atomizing system with the low pressure exhaust gas will be described in the following. As shown in FIG. 15, the exhaust gas WG is swirled at high speed by the exhaust gas swirling vanes 35 to atomize the water W discharged from the water outflow nozzle 32. The atomized water is mixed with the fuel gas G (WG) supplied from the divergent flame type nozzle 3*b* by the high speed swirling flow of the exhaust gas. Therefore, the mixing of the exhaust gas and the fuel gas and that of the fuel gas and the atomized water occur rapidly to reduce the flame temperature by making the flame temperature uniform due to the combustion delay of the fuel gas and absorption of the latent heat by the atomized water, thereby greatly reducing the generation of NOx.

The radiant tube burner including two modifications of the third embodiment noted above has two ways of water atomizing system. One is using pressurized gas (air, vapor and inert gas) within the range from 2 to 6 kg/cm$_2$ and the other is using low pressure gas (fuel gas, exhaust gas or the like) with the range from 300 to 1,000 mm AG.

Figure 16:
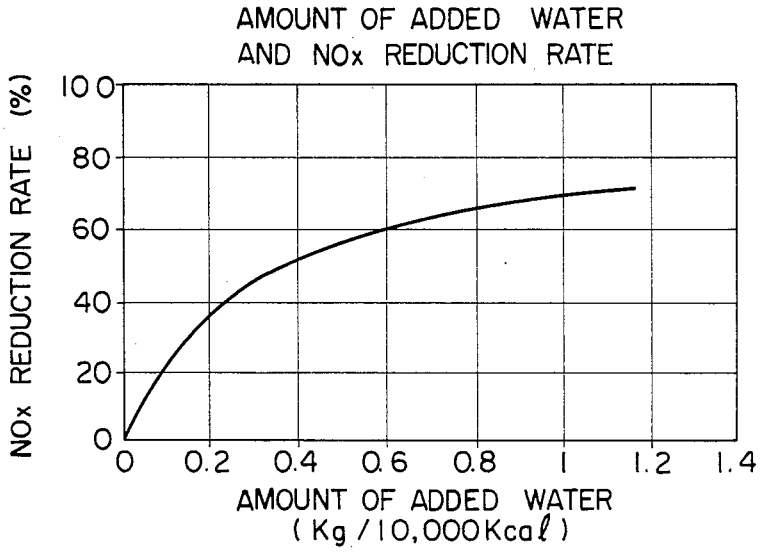
FIG. 16 shows the amount of additive water versus the reduction rate of NOx in the radiant tube burner according to the present invention.

NOx reduction rate by adding water in the radiant tube burner according to the present invention including the third and fourth embodiments is represented by the relation between the amount of additive water and the NOx reduction rate as shown in FIG. 16.

Operational factors of the radiant tube burner according to the present invention noted above are shown as follows:

Fuel COG: 4,500 kcal/Nm$^3$
calorific force: 145,000 kcal/h
air temperature for combustion: 400° C.
Residual $O_2$ contained in the exhaust gas 4 %
radiant tube type: 7 inch W type where, the amount of additive water is gradually increased to obtain higher NOx reduction rate (%).

As is obvious from the result, NOx can be efficiently reduced by adding water in the radiant tube burner. Furthermore, since the maximum tube temperature may be lowered, the extended tube life can be expected.

As has been described in the foregoing, the radiant tube burner according to the present invention will give utmost effectiveness when used for a furnace in which direct exposure of workpieces to waste gas is not desirable. i.e., non-oxidation furnaces, heat treatment furnaces and the like utilizing atmospheric gas and indirect heating system in which workpieces and waste gas should not come in contact. Applicable fields will include those industries such as metalworking industry, ceramics, glass industry, chemical industry, paper and fiber industry and food industry or the like.

What is claimed is:

1. In a radiant tube burner in which a nozzle of an axially elongated gas burner is coaxially placed within and spaced inwardly from an axially elongated combustion tube installed within and spaced radially inwardly from an axially elongated radiant tube, said combustion tube and radiant tube each have a first end and a second end spaced axially apart, the first end of said combustion tube being located within and spaced axially from the first end of said radiant tube and the second end of said radiant tube being spaced axially from the second end of said combustion tube and located within said radiant tube, said gas burner nozzle arranged to direct fuel gas into and toward the first end of said combustion tube and them into and toward the first end of said radiant tube, an annular space located between said gas burner and said combustion tube for the flow of primary air for effecting primary combustion with the fuel gas flowing out of the gas burner nozzle, another annular space located between said combustion tube and said radiant tube for the flow of secondary air for effecting secondary combustion, wherein the improvement comprises that the nozzle of said gas burner is a divergent flame type nozzle and said gas burner and nozzle are movable in the axial direction within said combustion tube, primary air swirling vanes located adjacent the nozzle of said gas burner within said annular space between said gas burner and said combustion tube for forming a swirled flame, and an air damper axially displaceably fitted on an axially extending primary air supply tube connected to the second end of said combustion tube and in axial alignment therewith and extending toward the second end of said radiant tube, for adjusting the primary and secondary air ratio.

2. A radiant tube burner according to claim 1, wherein means connected to said air damper for axially displacing said air damper and controlling the primary and secondary air ratio.

3. A radiant tube burner according to claim 1, wherein said divergent flame type nozzle is axially movable within a range of 100 to 500 mn relative to the first end of said combustion tube.

* * * * *